US011506372B1

(12) United States Patent
Zhang

(10) Patent No.: US 11,506,372 B1
(45) Date of Patent: Nov. 22, 2022

(54) LIGHTING DEVICE AND LIGHTING SYSTEM

(71) Applicant: APUTURE IMAGING INDUSTRIES CO., LTD., Guangdong (CN)

(72) Inventor: Binbin Zhang, Guangdong (CN)

(73) Assignee: APUTURE IMAGING INDUSTRIES CO., LTD., Shenzhen (CN)

( * ) Notice: Subject to any disclaimer, the term of this patent is extended or adjusted under 35 U.S.C. 154(b) by 0 days.

(21) Appl. No.: 17/530,547

(22) Filed: Nov. 19, 2021

(30) Foreign Application Priority Data

Sep. 17, 2021 (CN) ..... 202122265870.X

(51) Int. Cl.

| | |
|---|---|
| ***F21V 23/06*** | (2006.01) |
| ***F21V 17/10*** | (2006.01) |
| ***F21V 23/00*** | (2015.01) |
| ***F21V 23/04*** | (2006.01) |

(52) U.S. Cl.
CPC ..... *F21V 23/06* (2013.01); *F21V 17/101* (2013.01); *F21V 23/003* (2013.01); *F21V 23/04* (2013.01)

(58) Field of Classification Search
CPC ..... F21V 23/06; F21V 23/003; F21V 23/04; F21V 17/101
USPC ..... 362/368
See application file for complete search history.

(56) References Cited

U.S. PATENT DOCUMENTS 10,180,241 B1 * 1/2019 Van Winkle ..... F21V 21/005
2009/0073692 A1 * 3/2009 Berger ..... F21S 2/005 362/249.02
2012/0281412 A1 * 11/2012 Hente ..... H05B 47/175 362/249.02
2013/0176750 A1 * 7/2013 Ray ..... F21K 9/23 362/227
2013/0223055 A1 * 8/2013 Holland ..... F21V 15/01 362/218
2015/0062892 A1 * 3/2015 Krames ..... F21S 4/20 362/231
2015/0223301 A1 * 8/2015 Maa ..... H05B 47/12 315/112
2017/0167709 A1 * 6/2017 Kim ..... H05B 47/19
2019/0154241 A1 * 5/2019 Danville ..... F21S 4/28

FOREIGN PATENT DOCUMENTS

CN 211779814 U 10/2020

* cited by examiner

*Primary Examiner* — Bryon T Gyllstrom

(57) ABSTRACT

The present application discloses a lighting device and a lighting system. The lighting device includes: a first housing, internally provided with a processing circuit; a first conductive connector, disposed on the first housing and electrically connected with the processing circuit; a trigger switch, disposed on the first housing and spatially spaced from the first conductive connector, the trigger switch being electrically connected with the processing circuit; and a first connecting component, disposed on the first housing, and capable of selectively matching and being fixed to a second connecting component on a control device so that when the first connecting component and the second connecting component are mechanically fixed, a trigger component of the second connecting component may correspond to the trigger switch of the first connecting component, and the first conductive connector may be in contact with a second conductive connector on the control device.

10 Claims, 8 Drawing Sheets

C

LIGHTING DEVICE AND LIGHTING SYSTEM

CROSS REFERENCE TO RELATED APPLICATIONS

The present application claims the benefit of Chinese Patent Application No. 202122265870.X filed on Sep. 17, 2021, the contents of which are incorporated herein by reference in their entirety.

FIELD OF THE INVENTION

The present application relates to the technical field of movie and television lighting, in particular to a lighting device and a lighting system.

BACKGROUND OF THE INVENTION

The shooting process of movies, videos and advertisements needs to light shot objects and scenes, so a professional lighting device or system is required, and the lighting device or system can output different color temperatures, colors, etc. to meet the needs of different scenes. Such lighting device or system in the prior art includes a lighting level control device, and different parameter inputs can be realized through keys on the control device to realize different light outputs of the lighting device.

At present, a connection between the control device and the lighting device is a wired connection using a cable (hereinafter referred to as wired connection), or a wireless connection via Bluetooth or other means. In the wired connection, the cable has a certain influence on a user's operation (for example, the cable is too long and has a large weight), while the wireless connection has a high requirement for wireless signals, for example, when there are a plurality of devices around, a wireless control signal may be easily affected, and the connection is unstable.

SUMMARY OF THE INVENTION

In order to overcome at least one of the above-mentioned disadvantages of the prior art, the present application provides a lighting device and a lighting system, so as to solve the problems that a user is easily disturbed during wired control and pure wireless control is unstable, thereby improving the stability and security of electrical signal transmission, and enriching connection control modes of the lighting device and a control device.

The technical solution adopted in the present application to solve the problems is:

According to one aspect of the present application, the present application provides a lighting device, capable of being connected with a control device so as to be controlled by the control device, and including:

a first housing, internally provided with a processing circuit;

a first conductive connector, disposed on the first housing and electrically connected with the processing circuit;

a trigger switch, disposed on the first housing and spatially spaced from the first conductive connector, and electrically connected with the processing circuit; and a first connecting component, disposed on the first housing, and capable of being selectively fixed to a second connecting component on the control device in a matching manner so that when the first connecting component and the second connecting component are mechanically fixed, a trigger component of the second connecting component may correspond to the trigger switch of the first connecting component, the first conductive connector may be in contact with a second conductive connector on the control device, and the processing circuit may be connected with a control circuit of the control device.

According to one aspect of the present application, the present application provides a control device, capable of being connected with a lighting device so as to control the lighting device, and including:

a second housing, internally provided with a control circuit;

a second conductive connector, disposed on the second housing and electrically connected with the control circuit;

a trigger component, disposed on the second housing and spatially spaced from the second conductive connector; and a second connecting component, disposed on the second housing, and capable of being selectively fixed to a first connecting component on the lighting device in a matching manner so that the second conductive connector is electrically connected with a first conductive connector on the lighting device, and when the first connecting component and the second connecting component are mechanically fixed, the trigger component of the second connecting component corresponds to a trigger switch of the first connecting component, the first conductive connector may be in contact with the second conductive connector on the control device, and a processing circuit may be connected with the control circuit of the control device.

According to a further aspect of the present application, the present application provides a lighting system, including a lighting device and a control device configured to control the lighting device. The lighting device is any lighting device described above, and the control device is any control device described above.

It can be seen from the above-mentioned technical solution that the embodiments of the present application have at least the following positive effects:

In the lighting device of the present application, the first housing is provided with the processing circuit, the first connecting component, the first conductive connector and the trigger switch. The first connecting component may be assembled and fixed to the second connecting component on the control device in a matching manner so that the trigger component of the second connecting component can correspond to the trigger switch of the first connecting component, the processing circuit may then obtain an electrical signal generated by the trigger switch when the two are in corresponding contact, and may then control the first conductive connector to be in electrical communication with the processing circuit, and thus the first conductive connector may be in contact with the second conductive connector to form an electrical connection. When the control device and the lighting device are assembled and fixed together, if no external cable is connected between the control device and the lighting device at this moment, the control device can transmit the electrical signal through the first conductive connector and the second conductive connector to control the lighting device, effectively improving the stability and reliability of signal transmission, and ensuring that the signal transmission and control over the lighting device can also be realized in the absence of a wireless connection and an external cable connection. When the control device and the lighting device are not assembled and fixed, the trigger switch and the trigger component are not in corresponding contact, and the first conductive connector is exposed at this moment; however, since the processing circuit cannot obtain the electrical signal generated by the trigger switch when the two are in corresponding contact, the processing circuit cannot communicate with the first conductive connector, and thus the first conductive connector will not be charged, so the risk of electric shock or short circuit caused by exposure of the first conductive connector can be reduced.

Figure 1:
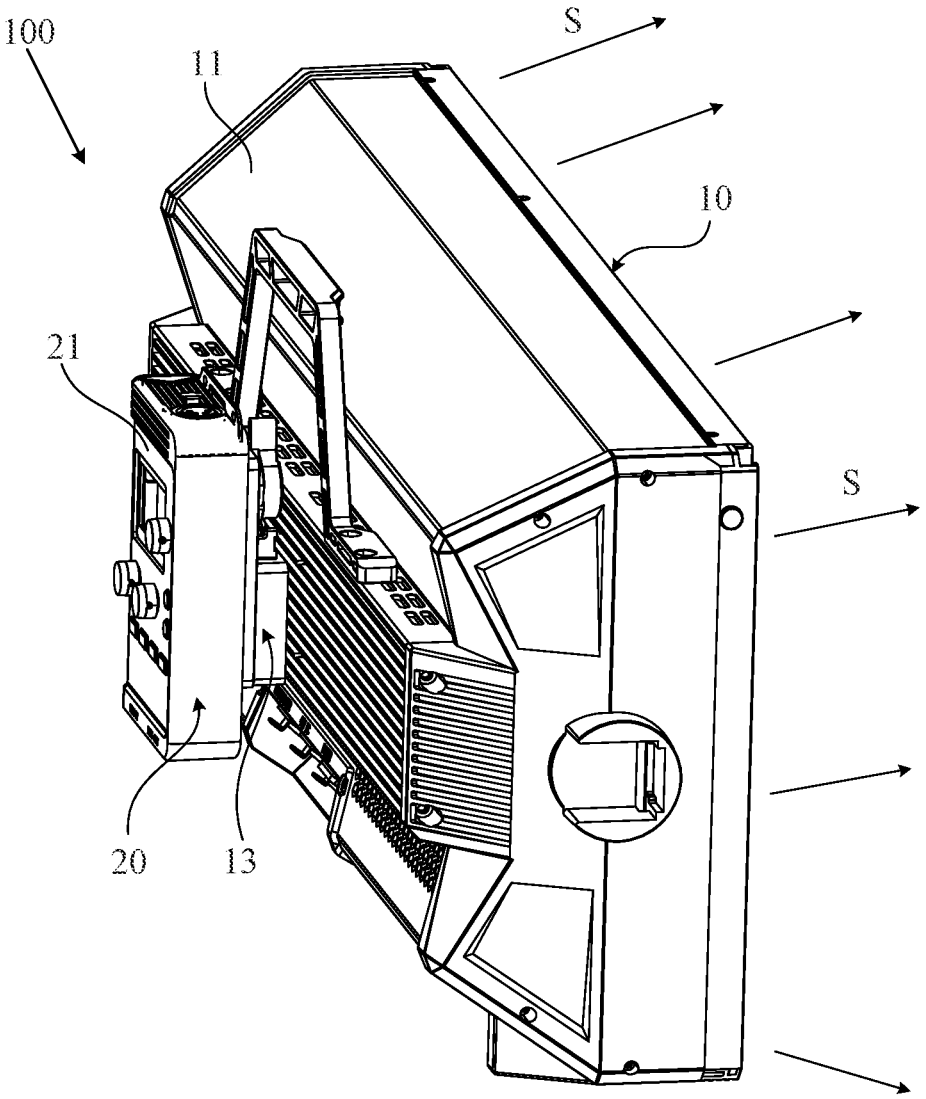
FIG. 1 is a schematic diagram of an overall structure of a lighting device according to one embodiment of the present application.

The meanings of the reference signs are as follows:

100. Lighting system; 10. Lighting device; 11. First housing; 211 and 111. Wired interface; 20. Control device; 115. Light source; 21. Second housing; 113. Processing circuit; 213. Control circuit; 13. Connecting structure; 1300. First connecting component; 1301. Second connecting component; 131. Assembly plate; 1311. Fourth mounting groove; 1312. Third mounting groove; 13121. Limiting raised edge; 1313. Second positioning groove; 132. Assembly base; 1321. Accommodating groove; 1322. Sliding groove; 1323. Reset post; 13231. Limiting protrusion; 1324. Reset mounting housing; 1325. Reset spring; 1326. First mounting groove; 1327. Through hole; 1328. Second mounting groove; 1329. First positioning groove; 133. Locking mechanism; 1331. Clamping plate; 13311. Driving groove; 1332. Eccentric driving wheel; 1333. Lock handle; 1334. Chuck; 13341. Arc notch; 2. First conductive connector; 201. Elastic contact pin; 22. First mounting member; 23. First lead pin; 221. First positioning protrusion; 222. First plug-in end; 223. First limiting bulge; 3. Second conductive connector; 31. Conductive contact; 32. Second mounting member; 33. Second lead pin; 34. Mounting spacer; 321. Second positioning protrusion; 322. Second plug-in end; 323. Second limiting bulge; 4. Trigger switch; 41. Magnetic sensor; 42. Third lead pin; 5. Trigger component; 51. Magnet; 6. Fixing plate; 61 and 64. Through groove; 62. Fixing hole; 63. Step.

DETAILED DESCRIPTION OF ILLUSTRATED EMBODIMENTS

For a better understanding and implementation, the technical solutions of embodiments of the present application will be clearly and completely described below with reference to the accompanying drawings of the embodiments of the present application.

In the description of the present application, it should be noted that the orientation or positional relationship indicated by the terms "upper", "lower", "front", "rear", "left", "right", "vertical", "horizontal", "top", "bottom", "inner", "outer", etc. is based on the orientation or positional relationship shown in the drawings, is merely to facilitate the description of the present application and simplify the description, and does not indicate or imply that apparatus or elements referred to must have a particular orientation or be constructed and operated in a particular orientation, and thus should not be construed as limiting the present application.

It should be noted that when an element is referred to as being "fixed" or "disposed" on another element, it may be directly on the other element or indirectly on the other element. When an element is referred to as being "connected" to another element, it may be directly connected to the other element or indirectly connected to the other element.

Unless otherwise defined, all technical and scientific terms used herein have the same meaning as commonly understood by one of ordinary skilled in the art to which the present application belongs. The terminologies used in the description of the present application herein are for the purpose of describing particular embodiments only and are not intended to be limiting of the present application.

Referring to FIGS. 1-9, the present application discloses a lighting system 100, including a lighting device 10 and a control device 20 configured to control the lighting device 10. The lighting device 10 and the control device 20 may be connected to each other, where connection may be understood as electrical communication. Examples include wired connections, wireless connections, and mechanical connections (i.e. there is physical contact). The lighting device 10 includes a first housing 11, a processing circuit 113 and a light source 115 may be disposed in the first housing 11, and the processing circuit 113 and the light source 115 are electrically connected. It should be understood that the electrical connection in the present application merely represents that the two may electrically transmit an electrical signal after being connected, but does not represent that the two are always in a charged working state. For example, the electrical connection may be understood as that the transmission of the electrical signal may be realized when the two are connected, and only a physical connection is possible when the two are not connected. The processing circuit 113 may include processing of electrical signals of power supply, drive, control, etc. so as to realize drive, control, etc. on the light source 115. The control device 20 includes a second housing 21, and the first housing 11 of the lighting device 10 and the second housing 21 of the control device 20 may be assembled and fixed via a connecting structure 13. A control circuit 213 is disposed in the second housing 21, and the control circuit 213 may receive a user's expected control input. For example, the second housing 21 may further be provided with parts such as knobs, a display screen and keys in an exposed manner, and the control circuit 213 is electrically connected to the above-mentioned knobs, keys, etc. so as to control the adjustment of various parameters such as luminous brightness, color temperature, saturation and various light effects of the light source 115.

The light source 115 may be light emitting diodes (LEDs), organic light emitting diodes, quantum dot light emitting diodes, etc., and the quantity of light sources 115 may be a single or a plurality of arrays. The light source 115 may be emitted from a light-emitting surface of the first housing 11, for example as indicated by partial line arrows S in FIG. 1. An outer contour of the first housing 11 may be or substantially be square, cylindrical, or elongated, etc. so that the lighting device 10 may be in the form of a product such as a spot lamp, panel lamp, bar lamp, etc. An outer contour of the second housing 21 of the control device 20 may also be or substantially be square, oval, etc., which is not specifically limited here. The first housing 11 and the second housing 21 may be detachably connected through the connecting structure 13. Detachable here is to be understood as that, for example, the second housing 21 may be hung against a side, facing away from the light-emitting surface, of the first housing 11, and of course, the second housing 21 may also be hung against other side surfaces of the first housing 11; and the second housing 21 may be kept separate from the first housing 11. Thus, the degree of freedom of the connection between the lighting device 10 and the control device 20 may be greatly enhanced. The connecting structure 13 may have one portion disposed on the first housing 11 and another portion disposed on the second housing 21. Of course, the connecting structure 13 may also be a separate part, and the separate connecting structure 13 may be detachably connected to any one of the first housing 11 or the second housing 21.

Figure 9:
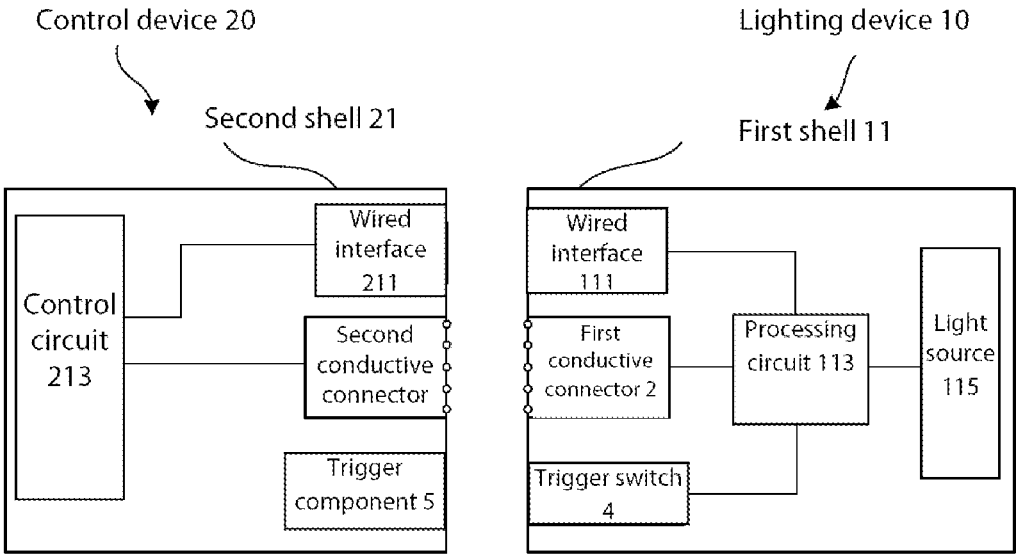
FIG. 9 is a schematic structural diagram of a lighting system according to an embodiment of the present application.

Referring to FIGS. 2-9, in some embodiments, the lighting device 10 further includes a first conductive connector 2, and the first conductive connector 2 is disposed on the first housing 11 and is electrically connected with the processing circuit 113. It can be understood that the first conductive connector 2 may be indirectly connected with the light source 115 as shown in FIG. 9, i.e., a signal may be transmitted from the first conductive connector 2 to the processing circuit 113 and then to the light source 115, where the processing circuit 113 should be understood broadly. It can be understood that the processing circuit 113 may of course further include a power supply circuit, a processing chip (MCU), a drive circuit, a boost-buck circuit, a communication circuit, etc.

Figure 2:
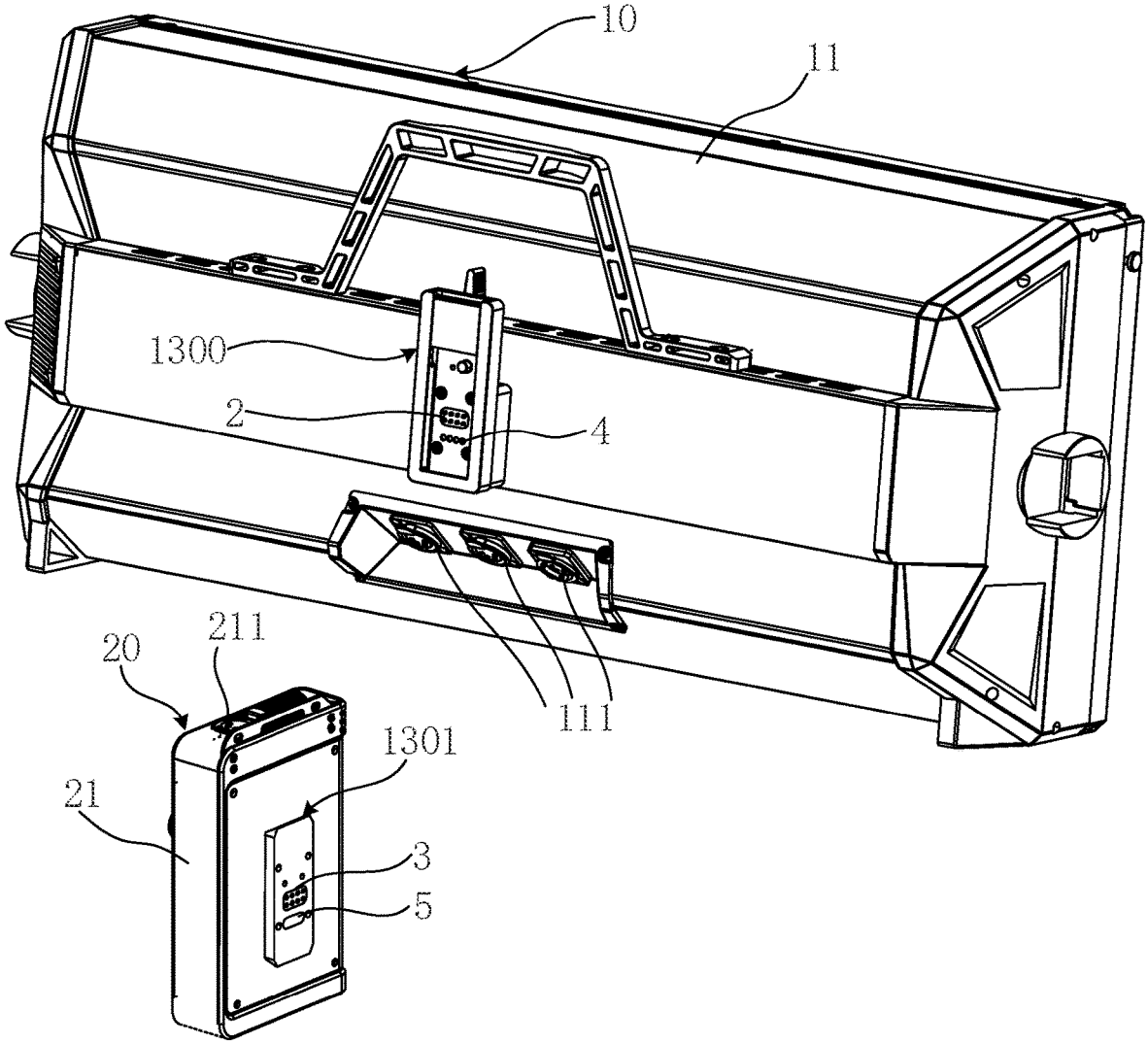
FIG. 2 is a schematic diagram showing a state where a control device and a first housing of a lighting device are separated according to one embodiment of the present application.

Referring to FIGS. 1 and 2 in combination, in some embodiments, the lighting device 10 further includes a trigger switch 4, and the trigger switch 4 is disposed on the first housing 11, and is spatially spaced from the first conductive connector 2, that is, the two are not in contact. The trigger switch 4 is electrically connected with the processing circuit 113. A first connecting component 1300 is disposed on the first housing 11, and is capable of being selectively fixed to a second connecting component 1301 on the control device in a matching manner so that when the first connecting component 1300 and the second connecting component 1301 are mechanically fixed, a trigger component 5 of the second connecting component 1301 may correspond to the trigger switch 4 of the first connecting component 1300. It can be understood that when the lighting device 10 and the control device 20 are hung up together, the trigger switch 4 and the trigger component 5 are just aligned. The first conductive connector 2 is in physical contact with a second conductive connector 3 on the control device 20 so that the processing circuit 113 may be electrically connected with the control circuit 213 of the control device through the first conductive connector 2 and the second conductive connector 3. It can be understood that the trigger switch 4 and the first conductive connector 2 may be located on the same part, but of course they may be located on different parts of the first housing 11 respectively, provided that when the lighting device 10 is matched with the control device 20, the conductive connectors 2 and 3 are aligned with each other, and the trigger switch 4 and the trigger component 5 are aligned.

It should be understood that when the trigger component 5 is aligned with the trigger switch 4, the processing circuit may further obtain an electrical signal generated by the trigger switch when the two are in corresponding contact, and may further control the first conductive connector 2 to be in electrical communication with the processing circuit 113, and thus the first conductive connector 2 and the second conductive connector 3 may make contact to form an electrical connection. When the control device 20 and the lighting device 10 are assembled and fixed (hung up) together, if no external cable is connected between the control device 20 and the lighting device 10 at this moment, the control device 20 may transmit an electrical signal through the first conductive connector 2 and the second conductive connector 3 to control the lighting device 10, effectively improving the stability and reliability of signal transmission, and ensuring that the signal transmission and the control over the lighting device can also be realized in the absence of a wireless connection and an external cable connection. When the control device 20 and the lighting device 10 are not assembled and fixed (hung up), the trigger switch 4 and the trigger component 5 are not in corresponding contact, and the first conductive connector 2 is exposed at this moment; however, since the processing circuit 113 cannot obtain the electrical signal generated by the trigger switch 4 when the two are in corresponding contact, the processing circuit 113 is kept electrically disconnected from the first conductive connector 2 (even if there is a physical connection, there is no electricity to be transmitted between the two), so the processing circuit 113 cannot realize electrical signal communication with the first conductive connector 2, and the first conductive connector 2 cannot be electrically charged, thereby reducing the risk of an electrical shock or short circuit caused by exposure of the first conductive connector 2.

Of course, the lighting device 10 may further include a wired interface 111, the control device 20 may further include a wired interface 211, and wires (not shown in the drawings) may be connected to the wired interfaces 111 and 211 to electrically connect the control device 20 and the lighting device 10. It can be understood that there may be at least one or more of a wireless control mode, a wired control mode, or a hanging-up control mode between the control device 20 and the lighting device 10. The wireless control mode is that the control device 20 and the lighting device 10 are connected through a wireless signal (such as WiFi and Bluetooth). The wired control mode is that the control device 20 and the lighting device 10 are connected between the wired interfaces 111 and 211 through a wire (such as a Spin XLR connection wire). The hanging-up control mode is that the control device 20 and the lighting device 10 are hung up together, namely having mechanical contact, and the two are electrically connected through a metal elastic contact.

The trigger switch 4 has a normal state and a trigger state: in the normal state, i.e., when no magnetic member is in contact with or close to the trigger switch 4, the trigger switch 4 is kept open, and an electrical signal cannot directly enter an internal circuit (such as the processing circuit 113) of the lighting device 10 through the first conductive connector 2, so that the internal circuit will not be connected or short-circuit, and at this moment, the lighting device 10 does not have the hanging-up control mode either; and in the trigger state, i.e., when a magnet is in contact with or close to the trigger switch 4, the trigger switch 4 is connected, the electrical signal may enter the processing circuit 113 directly through the first conductive connector 2, and at this moment, if there is no wired connection, the lighting device 10 may enter the hanging-up control mode to be controlled by the control device 20.

In some embodiments, referring to FIG. 2, the control device 20 includes the trigger component 5, and the trigger component 5 is disposed in correspondence with the trigger switch 4 and is capable of acting on the trigger switch 4 to change its on-off state. This correspondence may be understood as that the two may be spatially aligned. It can be understood that the trigger switch 4 is spaced from the first conductive connector 2 and is located below the first conductive connector 2, and the trigger component 5 is spaced from the second conductive connector 3 and is located below the second conductive connector 3. When the trigger component 5 is in aligned contact with or close to the trigger switch 4, the trigger switch 4 may be changed from an open state to a closed state, then an electrical signal is sent to the processing circuit 113, and the processing circuit 113 may be allowed to be electrically connected with the first conductive connector 2 after obtaining the electrical signal.

In some application scenes, most of the time for the lighting device 10, a driving circuit is in a power-on operating state, and at this moment, when the control device 20 is not hung up on the lighting device 10, the first conductive connector 2 is exposed. Since the first conductive connector 2 is electrically connected to the processing circuit 113 of the lighting device 10, the processing circuit 113 may be in a power-on operating state at this moment. If the user inadvertently touches a plurality of contact pins 201 of the first conductive connector 2 by hand or other conductors, the internal circuit of the lighting device 10 is prone to short-circuiting or being open, which is prone to causing damage to the lighting device 10. Therefore, another objective of the present application is to effectively avoid problems such as a short circuit caused by false touch. When the second housing 21 is not hung up on the first housing 11, the trigger switch 4 is not in contact with the trigger component 5 and is always electrically disconnected, this is, the processing circuit 113 cannot detect out the electrical signal, and the first conductive connector 2 cannot input the electrical signal to the processing circuit 113 either. Even if the plurality of contact pins 201 are connected (for example, a hand touch or a conductor contact wipe, etc.), the contact pins 201 may not be actually electrically connected, that is, it is impossible to input the electrical signal into the internal circuit of the lighting device 10 through the contact pins. When the second housing 21 is hung up on the first housing 11, the MCU in the processing circuit 113 may detect out a signal that the trigger component 5 (for example, a magnet 51) is in contact with the trigger switch 4, the processing circuit 113 is controlled to communicate with the first conductive connector 2, and at this moment, the electrical signal may be input to the light source 115 of the lighting device 10 through the plurality of contact pins 201 of the first conductive connector 2.

Referring to FIGS. 1, 2 and 9, in some embodiments, the control device 20 includes the second housing 21, and the second housing 21 is provided with the second conductive connector 3 corresponding to the first conductive connector 2. When the control device 20 is assembled (or hung up) on the first housing 11, the second conductive connector 3 and the first conductive connector are connected and in electrical communication so that the control circuit disposed in the control device 20 and the driving circuit in the first housing 11 may be in electrical communication through, for example, the trigger switch 4, and thus the control device 20 may control elements such as the light source in the lighting device 10.

In some embodiments, when the control device 20 and the lighting device 10 are connected through a cable and the control device 20 and the lighting device 10 are hung up, the trigger component 5 is in contact with the trigger switch 4, and at this moment, the control priority of the cable to be connected with the wired interfaces 111 and 211 is higher, that is, the electrical signal is controlled to be preferably transmitted between the wired interface 111, the cable and the wired interface 211. When the user removes the cable and the control device 20 and the lighting device 10 are still kept hung up, at this moment, electrical signals such as power supply and communication control, may still be transmitted through the first conductive connector 2 and the second conductive connector 3 being in contact with each other.

In some embodiments, referring to FIGS. 3-6, the trigger switch 4 may be a magnetic sensor 41, such as a reed pipe or a Hall element. The trigger component 5 may be the magnet 51. The magnet 51 may be a permanent magnet, such as neodymium iron boron, samarium cobalt, and aluminum nickel cobalt. Optionally, the magnet 51 may be an electromagnet, for example, an electromagnet is arranged in the control device 20 and is powered by a battery.

Further referring to FIGS. 2-9, in some embodiments, the connecting structure 13 includes the first connecting component 1300 disposed at the first housing 11 and the second connecting component 1301 disposed at the second housing 21, and the first connecting component 1300 and the second connecting component 1301 are assembled and fixed so as to realize the detachable connection (namely, hanging-up and separation) between the first housing 11 and the second housing 21.

In some embodiments, the first connecting component 1300 includes an assembly base 132 and a locking mechanism 133, and the second connecting component 1301 includes an assembly plate 131. The assembly plate 131 is fixed to the second housing 21 of the control device 20, the assembly base 132 is fixed to the first housing 11, and the trigger switch 4 and the first conductive connector 2 are spaced apart on the assembly base 132. The locking mechanism 133 is disposed on the assembly base 132 and is capable of sliding relative to the assembly base 132. A fixing means may be fixing through a fastener such as a screw. The assembly plate 131 may be assembled in the assembly base 132, and be fixed to the assembly base by the locking mechanism 133. The assembly base 132 may be a square plate, and may of course be in other shapes such as circular. One side of the assembly base 132 is provided with an accommodating groove 1321 configured to accommodate the assembly plate 131. Ends, in a length direction, of two side walls of the assembly base 132 are provided with sliding grooves 1322. The assembly plate 131 or the assembly base 132 may be made of a nonmagnetic material such as aluminum alloy. The magnetic sensor 41 is disposed on the assembly base 132, and the magnet 51 is disposed on the assembly plate 131, and leaks out of a side, facing away from the second housing 21, of the assembly plate 131, that is, the magnet 51 may face one side of the magnetic sensor 41.

In some embodiments, the locking mechanism 133 may refer to the solution disclosed in Application No. CN202020175277.9 in the prior art. The locking mechanism 133 includes a clamping plate 1331, and the clamping plate 1331 is connected in the sliding grooves 1322 in a sliding manner, and may abut against an end of the assembly plate 131 to fix the assembly plate 131 to the assembly base 132.

The locking mechanism 133 further includes an eccentric driving wheel 1332 rotatably disposed on the assembly base 132. The clamping plate 1331 is provided with a driving groove 13311 configured to allow the eccentric driving wheel 1332 to slide in. The eccentric driving wheel 1332 rotates relative to the assembly base 132 and slides along the driving groove 13311, so as to drive the clamping plate 1331 to slide in the sliding grooves 1322, thereby achieving a locking or unlocking process of the assembly plate 131. The locking mechanism 133 further includes a lock handle 1333, the lock handle 1333 is connected with the eccentric driving wheel 1332, and the eccentric driving wheel 1332 may be rotated by rotating the lock handle 1333. The lock handle 1333 is further provided with a chuck 1334, and the chuck 1334 is further provided with an arc notch 13341. A reset post 1323 further penetrates through the assembly base 132 in a width direction, and the reset post 1323 penetrates from one side of the assembly base 132 to the other side. The reset post 1323 is provided with a limiting protrusion 13231, and a size of the limiting protrusion 13231 is smaller than that of the arc notch 13341.

A reset mounting housing 1324 is fixed on the assembly base 132, and the reset post 1323 slides in the reset mounting housing 1324. A reset spring 1325 abutting against the reset post 1323 is further disposed in the reset mounting housing 1324. A size of the limiting protrusion 13231 is greater than that of the reset post 1323, so that the limiting protrusion 13231 may abut against a surface of the assembly base 132. The reset spring 1325 applies an elastic force to the reset post 1323 so that the limiting protrusion 13231 may abut against the surface of the assembly base 132.

The chuck 1334 has a locked position and an unlocked position. When the chuck 1334 is in the unlocked position, the arc notch 13341 is aligned with the limiting protrusion 13231, the reset spring 1325 applies the elastic force to the reset post 1323 so that the limiting protrusion 13231 may move towards the surface of the assembly base 132, so as to push the reset post 1323, and the assembly plate 131 may be pushed out from the accommodating groove 1321 of the assembly base 132. When the chuck 1334 is in the locked position, a chuck surface of the chuck 1334 abuts against the limiting protrusion 13231, so as to limit the reset post 1323 from entering the accommodating groove 1321. Of course, in other possible implementations, the locking mechanism 133 may further adopt a buckle structure or a screw or bolt-nut component as would occur to those skilled in the art.

Of course, in other possible implementations, a structure of the first connecting component 1300 and a structure of the second connecting component 1301 may be interchanged, i.e., the first connecting component 1300 is provided with the assembly plate 131, and the second connecting component 1301 is provided with the assembly base 132 and the locking mechanism 133, which may also realize the detachable connection between the first housing 11 and the second housing 21 of the control device 20.

Figure 3:
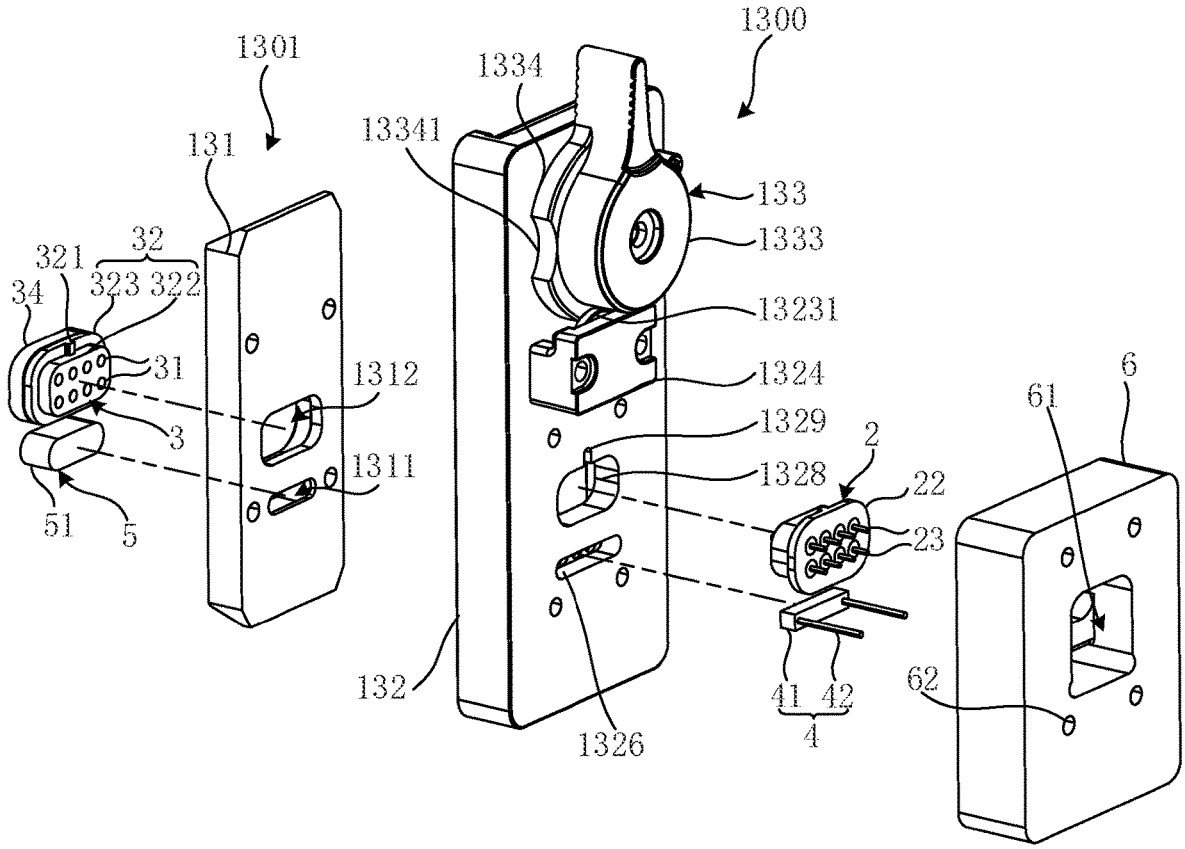
FIG. 3 is a first exploded schematic diagram of a connecting structure of a lighting device according to one embodiment of the present application.
Figure 4:
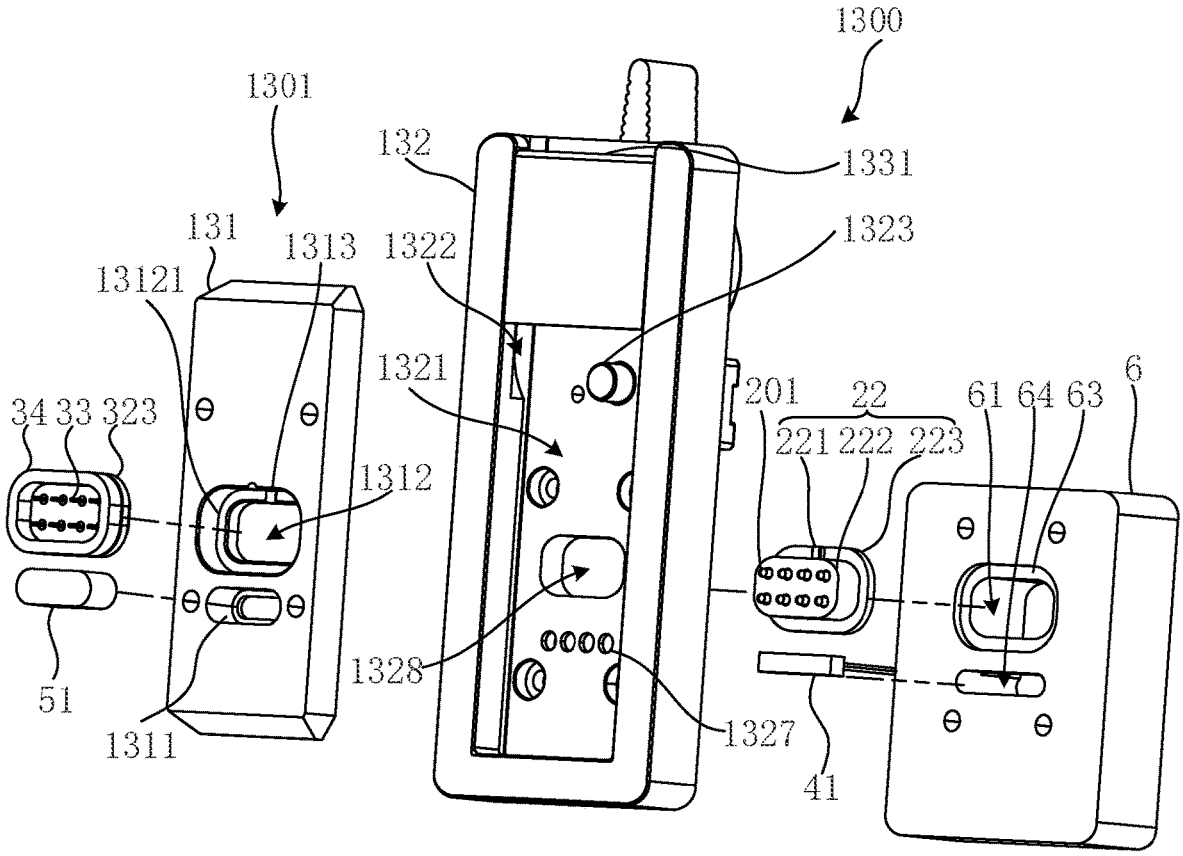
FIG. 4 is a second exploded schematic diagram of a connecting structure of a lighting device according to one embodiment of the present application.
Figure 6:
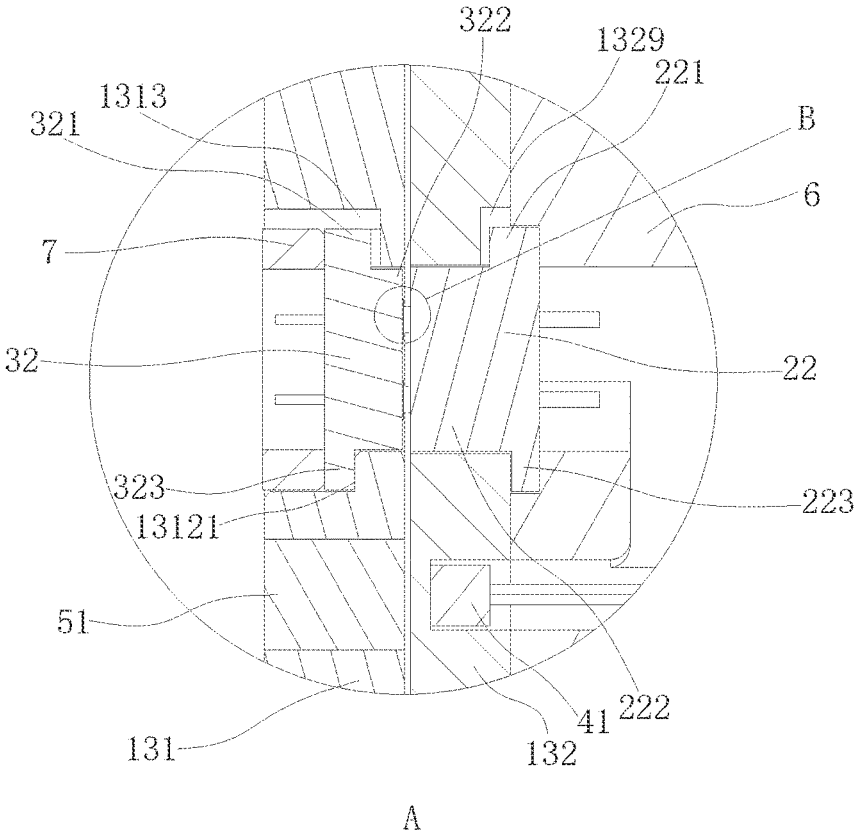
FIG. 6 is an enlarged view of a portion A in FIG. 5.
Figure 7:
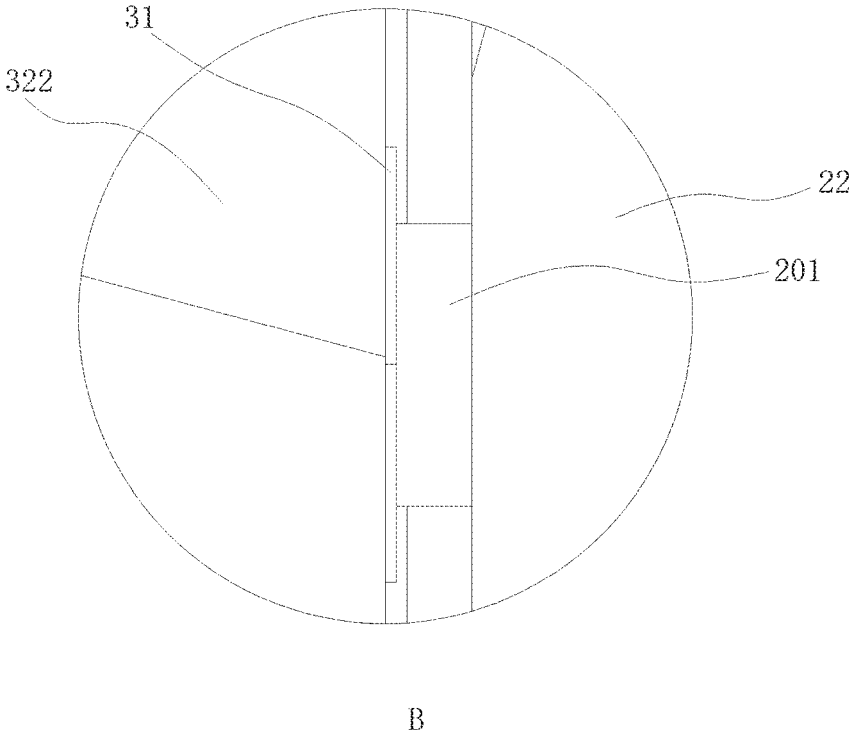
FIG. 7 is an enlarged view of a portion B in FIG. 6.
Figure 8:
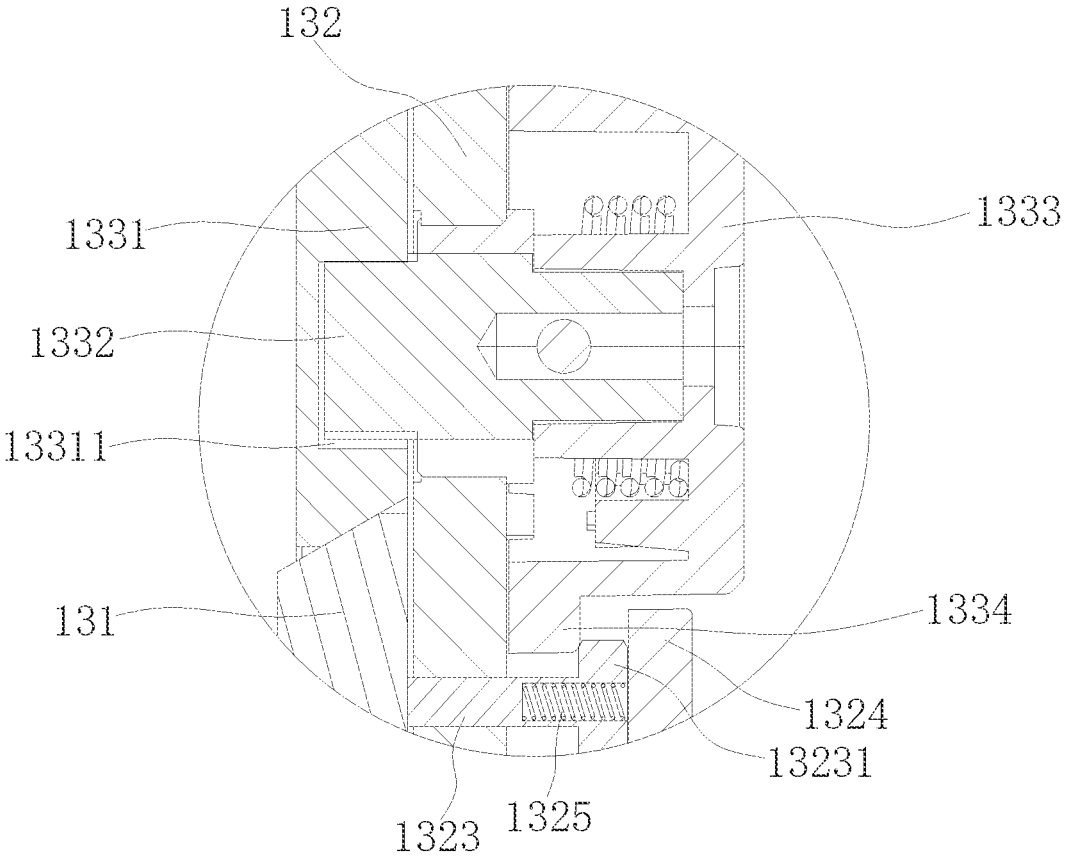
FIG. 8 is an enlarged view of a portion C in FIG. 5.

Referring to FIGS. 3, 4 and 6, in some embodiments, the assembly base 132 is provided with a first mounting groove 1326 where the magnetic sensor 41 (reed pipe) is mounted, and the first mounting groove 1326 may be located on a side, facing the first housing (11), of the assembly base 132. The assembly base 132 further includes an adhesive layer (not shown in the drawings), and the adhesive layer is located between the first mounting groove 1326 and the magnetic sensor 41 to fix the magnetic sensor 41. Thus, the magnetic sensor 41 may be fixed in the first mounting groove 1326 by gluing or direct clamping. The trigger switch 4 further includes a third lead pin 42, one end of the third lead pin 42 is electrically connected with the magnetic sensor 41, and the other end of the third lead pin 42 extends out of the first mounting groove 1326 and penetrates through the first housing 11 to be electrically connected to the processing circuit 113. The assembly plate 131 is provided with a fourth mounting groove 1311 where the magnet 51 is mounted. It can be understood that a shape of the first mounting groove 1326 and a shape of the fourth mounting groove 1311 may be the same, for example, both being square or oval, so that a magnetic field strength of the magnet 51 may correspond to a position of the reed pipe uniformly. Of course, the shapes of the two may not be identical, provided that the positions may correspond and a magnetic field of the magnet 51 may act on the magnetic sensor 41. The magnet 51 is mounted in the fourth mounting groove 1311, and a part of the magnet 51 may leak out relative to the assembly plate 131 and has a surface lower than a surface of the assembly plate 131, so that the magnet 51 may be effectively fixed and protected against wear. Of course, the two may also be flush or nearly flush. Optionally, of course, in order to protect the magnet 51 against wear, in other possible implementations, a surface of the magnet 51 may be located in the fourth mounting groove 1311, and is spaced from the surface of the assembly plate 131.

Referring to FIGS. 3 and 4, the first mounting groove 1326 may be a blind groove, the assembly base 132 is further provided with at least one through hole 1327, and the through holes 1327 correspond to the magnetic sensor 41. For example, in a through direction of the through holes 1327, the through holes 1327 are aligned with the magnetic sensor 41 in position. The quantity of the through holes 1327 may be 1, 2, 3, 4, 5 or even more, etc. When there are two or more through holes 1327, the through holes 1327 may be arranged at intervals in a length direction of the first mounting groove 1326, and the through holes 1327 penetrate from the surface of the assembly base 132 to communicate with a bottom of the first mounting groove 1326. Of course, the adhesive layer may also properly fill the through holes 1327 to make the fixing more stable. The provision of the through holes 1327 can reduce the blocking of magnetic flux of the magnet 51 by a wall thickness of the assembly base 132, which effectively reduces the magnetic flux loss. On the other hand, the advantage of providing the first mounting groove 1326 as the blind groove is that: the magnetic sensor 41 can be protected, damage to the magnetic sensor 41 caused by directly disposing the magnetic sensor 41 to be in contact with the outside of the assembly base 132 is effectively avoided, and thus the service life of the magnetic sensor 41 is extended.

In other implementations, the first mounting groove 1326 may be a through groove 61, and the first mounting groove 1326 may be filled with a protective material on a side, facing the magnet 51, of the magnetic sensor 41, such as a sealant layer of plastic or rubber, to achieve mounting protection for the magnetic sensor 41.

Referring to FIGS. 3, 4, 6 and 7, in further other embodiments, the first conductive connector 2 includes a first mounting member 22, the plurality of elastic contact pins 201 and first lead pins 23. The first lead pins 23 are electrically connected with the elastic contact pins 201, the elastic contact pins 201 are disposed on the first mounting member 22 and face away from the first housing 11. The first lead pins 23 are disposed on the first mounting member 22 and penetrate through the first housing 11 to be electrically connected to the processing circuit 113. The first mounting member 22 and the magnetic sensor 41 are fixed to the assembly base 132 at an interval and are located in the accommodating groove 1321. Since both are located in the accommodating groove 1321 instead of directly being flush with the assembly base 132 and exposed, false contact of the magnetic sensor 41 by an external magnetic member may be effectively reduced. The quantity of the elastic contact pins 201 may be, for example, 3, 6, or 8, etc. The elastic contact pins 201 may be set in an array, and may be, for example, pogopins.

The second conductive connector 3 includes a second mounting member 32, a plurality of conductive contacts 31 and second lead pins 33. The second mounting member 32 is fixed between the assembly plate 131 and the second housing 21. The second lead pins 33 are connected with the conductive contacts 31. The conductive contacts 31 are disposed on the second mounting member 32 and face away from the second housing 21. The second lead pins 33 are disposed on the second mounting member 32 and penetrate through the second housing 21 to be electrically connected to the control circuit 213. The quantity of the elastic contact pins 201 is consistent with the quantity of the conductive contacts 31, and the positional arrangement of the conductive contacts 31 is in one-to-one correspondence with the positional arrangement of the elastic contact pins 201. In other possible implementations, the quantity of the elastic contact pins 201 and the quantity of conductive contacts 31 may be set to be different, provided that they may make contact with each other.

In one embodiment, taking the magnetic sensor 41 being the reed pipe as an example, the reed pipe is in an open state when not magnetically induced, and when the control device 20 is separated from the lighting device 10, the reed pipe is in a normally open state, so that the processing circuit 113 cannot obtain a signal of the reed pipe. When the control device 20 and the lighting device 10 are in hung-up contact, the magnet 51 is close to the reed pipe, so that the reed pipe is closed, the processing circuit 113 obtains an electrical signal, the processing circuit 113 may be controlled to allow connection between the processing circuit 113 and the elastic contact pins 201, and thus the electrical signal may enter the processing circuit from the conductive contacts 31 to the elastic contact pins 201 to control the light source.

Referring to FIGS. 3, 4, 6 and 7, in some embodiments, the first mounting member 22 may further include a first plug-in end 222 and a first limiting bulge 223 surrounding the first plug-in end 222. A second mounting groove 1328 is formed in the assembly base 132. The first plug-in end 222 and the first limiting bulge 223 are located in the second mounting groove 1328. The plurality of elastic contact pins 201 and the first lead pins 23 are disposed on the first plug-in end 222. The elastic contact pins 201 leak out relative to the second mounting groove 1328. The first limiting bulge 223 is located at an end facing away from the elastic contact pins 201. The first plug-in end 222 is in plug-in fit with the second mounting groove 1328. The first limiting bulge 223 abuts against the surface of the assembly base 132. Thus, the first mounting member 22 may be fixed to the assembly base 132 to fix the elastic contact pins 201 to the assembly base 132.

In further other embodiments, referring to FIGS. 3, 4, 6 and 7, a first positioning protrusion 221 is disposed on the peripheral surface of the first mounting member 22, the second mounting groove 1328 where the first mounting member 22 is mounted is formed in the assembly base 132, and a first positioning groove 1329 matching the first positioning protrusion 221 is further formed in the side wall of the second mounting groove 1328. It can be understood that in some application scenes, since there are too many elastic contact pins 201, the first mounting member 22 is in a regular shape most of the time, and in order to ensure that the elastic contact pins 201 are mounted in the correct sequence and orientation (a plurality of rows of elastic contact pins 201 are allowed to be mounted in only one orientation), the first positioning protrusion 221 may be pre-fixed into the first positioning groove 1329 to act as guiding and fixing, which effectively avoids reverse mounting of the elastic contact pins 201 and improves the assembly accuracy of the components (such as the elastic contact pins 201).

Referring to FIGS. 3, 4, 6 and 7, in some embodiments, lengths of only a part of the lead pins 23 and 42 are shown exemplarily. The first connecting component 1300 may further include a fixing plate 6, and the fixing plate 6 is disposed between the first housing 11 and the assembly base 132. The lead pins 23 and the lead pins 42 penetrate through the fixing plate 6 and are electrically connected into the first housing 11, so as to enable wires of the trigger switch 4 and the first conductive connector 2 to be electrically connected into the first housing 11 more safely.

Referring to FIGS. 2-4, in some embodiments, the fixing plate 6 is provided with fixing holes 62, the assembly base 132 and the first housing 11 are also provided with fixing holes, and the assembly base 132 and the fixing plate 6 may be fixedly connected to the first housing 11 through a mode that screws or bolts and nuts, or the like penetrate through the fixing holes. The fixing plate 6 is provided with a through groove 61 and a through groove 64, the lead pins 23 may penetrate through the through groove 61, and the lead pins 42 may penetrate through the through groove 64 to be electrically connected to the circuit board in the first housing 11. A side, in contact with the assembly base 132, of the periphery of the through groove 61 of the fixing plate 6 may further be provided with a step 63. The first limiting bulge 223 is in limited abutting connection with the step 63, so that a mounting surface of the fixing plate 6 and a mounting surface of the assembly base 132 are flush, limiting and fixing of the first conductive connector 2 are realized, and the risk of looseness of the first limiting bulge 223 of the first conductive connector 2 is reduced.

Referring to FIGS. 3, 4, 6, and 7, in some embodiments, the second conductive connector 3 may further include the second mounting member 32, the plurality of conductive contacts 31 and the second lead pins 33. The second mounting member 32 is fixed between the assembly plate 131 and the second housing 21. The second lead pins 33 are connected with the conductive contacts 31. The conductive contacts 31 are disposed on the second mounting member 32 and face away from the second housing 21. The second lead pins 33 are disposed on the second mounting member 32 and penetrate through the second housing 21 to be electrically connected to the control circuit 213.

In another embodiments, referring to FIGS. 3-7, the second mounting member 32 includes a second plug-in end 322 and a second limiting bulge 323. The second limiting bulge 323 is located at one end of the second plug-in end 322. The conductive contacts 31 penetrate through the second plug-in end 322. The second limiting bulge 323 is provided with the conductive contact pins (the length of part of the lead pins 33 is merely given exemplarily in the figures) surrounding the second plug-in end 322 to be electrically connected with a circuit board inside the second housing 21. Conductive contact surfaces of the conductive contacts 31 are located on an end, facing away from the second limiting bulge 323, of the second plug-in end 322. The conductive contact surfaces of the conductive contacts 31 are flush or nearly flush with the surface of the second plug-in end 322, or the conductive contact surfaces of the conductive contacts 31 are lower relative to the surface of the second plug-in end 322. The second plug-in end 322 is plugged into a third mounting groove 1312, the conductive contact surfaces of the conductive contacts 31 leak out relative to the third mounting groove 1312, and the conductive contact surfaces of the conductive contacts 31 are lower relative to the surface, away from the second housing 21, of the assembly plate 131 or the two are flush. The third mounting groove 1312 is internally provided with a limiting raised edge 13121 abutting against the second limiting bulge 323. The second limiting bulge 323 abuts against the limiting raised edge 13121, so that the surface of an end, facing away from the second limiting bulge 323, of the second plug-in end 322 is flush with the surface of the assembly plate 131. The two may also form a height difference, and a filling block may be added during this time to compensate for the height difference. The surfaces of the elastic contact pins 201 and the conductive contacts 31 may also be plated with a metal coating, such as copper and gold.

A second positioning protrusion 321 is disposed on the peripheral surface of the second mounting member 32. The assembly plate 131 is provided with the third mounting groove 1312 where the second mounting member 32 is mounted. A second positioning groove 1313 is formed in the wall of the third mounting groove 1312. The second positioning protrusion 321 is adapted to the second positioning groove 1313, and the second mounting member 32 is positioned and fixed on the assembly plate 131. By the same reasoning, similar to the function of the first mounting member 22, the provision of the second positioning protrusion 321 can effectively avoid the risk of damage to the device caused by reverse mounting of the second mounting member 32 and the connection error between the elastic contact pins 201 and the conductive contacts 31.

Figure 5:
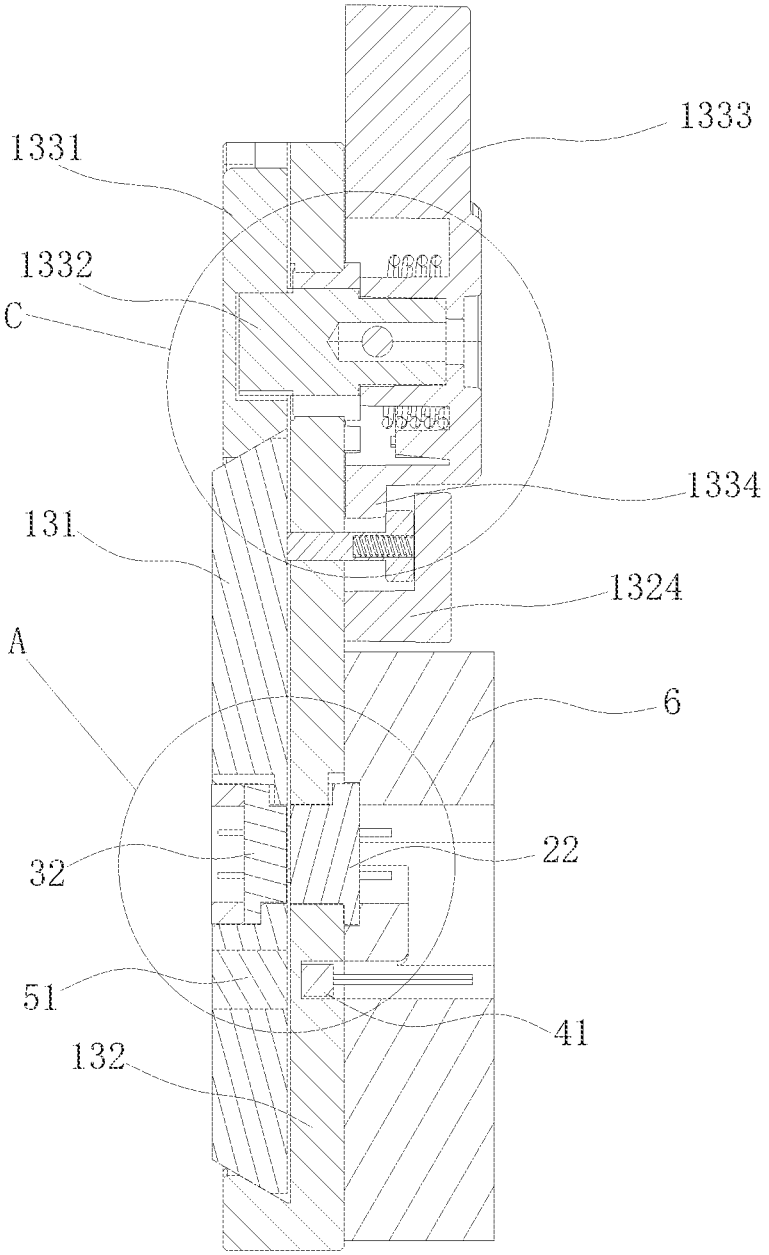
FIG. 5 is a schematic diagram of a longitudinal cross section of a connecting structure of a lighting device according to one embodiment of the present application.

Referring to FIGS. 5 and 6, after the elastic contact pins 201 are fixed to the assembly base 132, the elastic contact pins 201 may protrude from a bottom surface of the accommodating groove 1321, so that when the assembly plate 131 is assembled in the accommodating groove 1321, the elastic contact pins 201 may abut against and be in contact with the conductive contacts 31, thereby realizing electrical communication between the control circuit of the control device 20 and the light source of the lighting device 10.

In some embodiments, referring to FIGS. 3, 4 and 6, the second mounting member 32 may be a plastic member, a side, facing away from the surfaces of the conductive contacts 31, of the second mounting member 32 is further provided with a mounting spacer 34. The mounting spacer 34 may be annular. One side of the mounting spacer 34 abuts against the second mounting member 32, and the other side of the mounting spacer 34 abuts against the second housing 21. The mounting spacer 34 may be flush with the assembly plate 131, so that the assembly plate 131 is fixed to the second housing 21 more stably. Thus, the risk of looseness of the second conductive connector 3 can be effectively reduced, and mounting is more secure and stable.

In some embodiments, the elastic contact pins 201 may further include power supply contact pins, communication contact pins, a ground contact pin, etc. The quantity of the power supply contact pins and the quantity of the communication contact pins may be the same. There may be a plurality of power supply contact pins, for example two, and there may be a plurality of communication contact pins, for example two. There may be one ground contact pin. Of course, the quantity of the communication contact pins may be set to be greater than the quantity of the power supply contact pins. The power supply contact pins and the communication contact pins may be disposed in rows or columns at intervals, but may of course be alternately disposed at intervals. The conductive contacts 31 may further include corresponding power supply contacts, communication contacts, ground contacts, etc. The power supply contact pins and the power supply contacts correspond to each other, and the two may be configured to transmit a power supply signal to drive internal operation. The communication contact pins and the communication contacts correspond to each other and both may be configured to transmit a communication control signal of the control device 20 for the lighting device 10. The above-mentioned mutual correspondence can be understood as that the quantity of the two can be the same and the positions of the two can be aligned.

It should be understood that the lighting device 10 or the control device 20 of the present application may further include fasteners such as screws or bolts, handles, conjugate brackets, driving circuit boards, control circuit boards, adhesive layers and other components necessary for the implementation of the present application, which will not be described in detail here.

An embodiment of the present application further provides a lighting system 100, including a lighting device 10 and a control device 20. The control device 20 may be hung up on the lighting device 10 through a connecting structure 13. Reference is made to the above-mentioned embodiments for a description of the lighting device 10 and the control device 20, which will not be described in detail here.

The use of the embodiments of the present application is:

When the control device 20 is separated from the lighting device 10, namely, when the second housing 21 is not hung up on the first housing 11 or is detached from the first housing 11, the trigger switch 4 is not changed, the processing circuit 113 cannot obtain a signal from the trigger switch 4, the first conductive connector 2 and the processing circuit 113 cannot transmit an electrical signal, the electrical signal cannot enter the light source of the lighting device 10 from the conductive contacts 31 to the elastic contact pins 201 of the control device 20, and at the same time, power of the lighting device 10 cannot be transmitted through the processing circuit 113 to the elastic contact pins 201, which reduces the risk of false touch or short circuit.

When the control device 20 is hung up on the lighting device 10, for example, being assembled in the accommodating groove 1321 of the assembly base 132 through the assembly plate 131, the chuck 1334 is rotated to drive the clamping plate 1331 to press a dismounting plate, so as to fix the dismounting plate to the assembly base 132, that is, the second housing 21 is fixed to the first housing 11. At this moment, the magnetic sensor 41 is triggered by the magnet 51 on the assembly plate 131, and the processing circuit 113 detects out the electric signal, and then controls the electrical transmission conduction between the processing circuit 113 and the elastic contact pins 201, so that the electrical signal of the control device 20 may enter the processing circuit 113 from the conductive contacts 31 to the elastic contact pins 201, and the light source of the lighting device 10 may be controlled by the control device 20.

The technical means disclosed in the solutions of the present application are not limited to the technical means disclosed in the above-mentioned implementations, but also include technical solutions composed of any combination of the above technical features. It should be pointed out that for those of ordinary skill in the art, without departing from the principles of the present application, several improvements and modifications can be made, and these improvements and modifications are also regarded as the protection scope of the present application.

The invention claimed is:

1. A lighting device, capable of being connected with a control device so as to be controlled by the control device, and characterized by comprising:

a first housing, internally provided with a processing circuit; a first conductive connector, disposed on the first housing and electrically connected with the processing circuit; a trigger switch, disposed on the first housing and spatially spaced from the first conductive connector, wherein the trigger switch is electrically connected with the processing circuit; and a first connecting component, disposed on the first housing, and capable of being selectively fixed to a second connecting component on the control device in a matching manner so that when the first connecting component and the second connecting component are mechanically fixed, a trigger component of the second connecting component corresponds to the trigger switch of the first connecting component and the first conductive connector is electrically connected with a second conductive connector on the control device;

wherein the first connecting component comprises an assembly base, the assembly base is connected with the first housing, and the trigger switch and the first conductive connector are disposed on the assembly base at an interval.

2. The lighting device according to claim 1, characterized in that the trigger switch comprises a magnetic sensor, and the trigger component comprises a magnet.

3. The lighting device according to claim 2, wherein the first connecting component further comprises a locking mechanism, the assembly base is provided with an accommodating groove configured to accommodate the second connecting component, the magnetic sensor and the first conductive connector are disposed on a bottom wall of the accommodating groove at an interval, and the locking mechanism is disposed on the assembly base, is capable of sliding relative to the assembly base, and is configured to lock and fix the second connecting component and the assembly base.

4. The lighting device according to claim 3, characterized in that a side, facing the first housing, of the assembly base is provided with a first mounting groove, the magnetic sensor is fixed in the first mounting groove, the trigger switch further comprises a third lead pin, one end of the third lead pin is electrically connected with the magnetic sensor, and another end of the third lead pin extends out of the first mounting groove and penetrates through the first housing to be electrically connected to the processing circuit.

5. The lighting device according to claim 4, characterized in that the assembly base further comprises an adhesive layer, the adhesive layer is located between the first mounting groove and the magnetic sensor to fix the magnetic sensor, a position, aligned with the first mounting groove, of the assembly base is further provided with at least one through hole communicating with the first mounting groove, and the through holes correspond to the magnetic sensor.

6. The lighting device according to claim 4, characterized in that the first conductive connector comprises a first mounting member, a plurality of elastic contact pins and first lead pins, the first lead pins are electrically connected with the elastic contact pins, the elastic contact pins are disposed on the first mounting member and face away from the first housing, the first lead pins are disposed on the first mounting member and penetrate through the first housing to be electrically connected to the processing circuit, and the first mounting member is fixed to the assembly base and is located in the accommodating groove.

7. The lighting device according to claim 6, characterized in that the first mounting member comprises a first plug-in end and a first limiting bulge, the first limiting bulge surrounds the first plug-in end, the assembly base is further provided with a second mounting groove, the first plug-in end and the first limiting bulge are located in the second mounting groove, the plurality of elastic contact pins and the first lead pins are disposed on the first plug-in end, and the elastic contact pins leak out relative to the second mounting groove.

8. The lighting device according to claim 7, characterized in that the first mounting member is provided with a first positioning protrusion, a wall of the second mounting groove is further provided with a first positioning groove, and the first positioning protrusion is fixed in the first positioning groove.

9. The lighting device according to claim 6, characterized in that the lighting device further comprises a fixing plate, the fixing plate is disposed between the assembly base and the first housing, the fixing plate abuts against a side surface, facing the first housing, of the first mounting member, and the first lead pins and the third lead pin penetrate through the fixing plate and the first housing to be electrically connected to the processing circuit.

10. A lighting system, comprising a control device and the lighting device according to claim 1, wherein the lighting device is capable of being fixed to the control device in a matching manner.

* * * * *